US007501925B2

(12) United States Patent
Naito et al.

(10) Patent No.: US 7,501,925 B2
(45) Date of Patent: Mar. 10, 2009

(54) MAGNETIC CORE USING AMORPHOUS SOFT MAGNETIC ALLOY

(75) Inventors: Yutaka Naito, Niigata-ken (JP); Kazuo Aoki, Niigata-ken (JP); Masatomi Abe, Niigata-ken (JP); Kazuya Kaneko, Niigata-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 11/864,404

(22) Filed: Sep. 28, 2007

(65) Prior Publication Data

US 2008/0078474 A1 Apr. 3, 2008

(30) Foreign Application Priority Data

Sep. 29, 2006 (JP) ..... 2006-266216
Jul. 6, 2007 (JP) ..... 2007-178930

(51) Int. Cl.
*H01F 27/24* (2006.01)
*H01F 1/153* (2006.01)
*H01F 1/24* (2006.01)

(52) U.S. Cl. ..... 336/233; 148/304

(58) Field of Classification Search ..... None
See application file for complete search history.

(56) References Cited

U.S. PATENT DOCUMENTS 4,543,208 A 9/1985 Horie et al.
5,178,689 A * 1/1993 Okamura et al. ..... 148/306
5,522,948 A * 6/1996 Sawa et al. ..... 148/308
6,284,060 B1 9/2001 Matsutani et al.
7,132,019 B2 11/2006 Koshiba et al.
2005/0236071 A1* 10/2005 Koshiba et al. ..... 148/304
2006/0170524 A1* 8/2006 Fujiwara et al. ..... 336/83

FOREIGN PATENT DOCUMENTS

JP 2005-354001 12/2002
JP 2003-007536 1/2003

* cited by examiner

*Primary Examiner*—John P. Sheehan
(74) *Attorney, Agent, or Firm*—Brinks Hofer Gilson & Lione

(57) ABSTRACT

A magnetic core made of a mixed material including powder of an amorphous soft magnetic iron alloy and about 10% by volume or more of nonmagnetic inorganic powder, the amorphous soft magnetic iron alloy being expressed by the following composition:

$$Fe_{100-a-b-x-y-z-w-t}CO_aNi_bM_xP_yC_zB_wSi_t$$

wherein M is one or two or more elements selected from among Cr, Mo, W, V, Nb, Ta, Ti, Zr, Hf, Pt, Pd and Au, and a, b, x, y, z, w and t represent composition ratios satisfying 0 atom %≦x≦3 atom %, 2 atom %≦y≦15 atom %, 0 atom %<z≦8 atom %, 1 atom %≦w≦12 atom %, 0.5 atom %≦t≦8 atom %, 0 atom %≦a≦20 atom %, 0 atom %≦b≦5 atom %, and 70 atom %≦(100-a-b-x-y-z-w-t)≦80 atom %.

5 Claims, 7 Drawing Sheets

MAGNETIC CORE USING AMORPHOUS SOFT MAGNETIC ALLOY

CLAIM OF PRIORITY

This application claims benefit of the Japanese Patent Application No. 2006-266216 filed on Sep. 29, 2006 and No. 2007-178930 filed on Jul. 6, 2007, which are hereby incorporated by reference.

BACKGROUND

1. Field of the Invention

The present invention relates to a magnetic core of a compressed compact used in a coil for a power supply circuit and also relates to a method of producing the magnetic core.

2. Description of the Related Art

Choke coils are used in step-up and step-down circuits and smoothing circuits of electronic devices. The choke coil accumulates, as magnetic energy, a magnetic field generated by a current. The number of lines of magnetic force permeable through a magnetic core has a limitation. Upon reaching the limitation, even when a current supplied to the choke coil is increased, the number of lines of magnetic force passing through the magnetic core is not increased over the limitation and the accumulated magnetic energy cannot be increased any more (magnetic saturation). If relative permeability of a core material constituting the magnetic core is large, a larger number of lines of magnetic force are generated even with a small current, thus causing the magnetic saturation. Accordingly, a magnetic core made of such a core material having large relative permeability is not suitable for a choke coil used in a power supply of an electronic device in which a large current flows. For this reason, the magnetic cores used in these applications have been designed such that a gap is formed in a magnetic path to generate a demagnetizing field in a direction to reduce a magnetic field within the magnetic core, thus reducing apparent permeability (see Patent Document 1; Japanese Unexamined Patent Application Publication No. 2003-7536).

As an amorphous soft magnetic iron alloy, there is known a core material having a significantly small core loss (see Patent Document 2; U.S. Pat. No. 7,132,019 (Japanese Unexamined Patent Application Publication No. 2005-307291)). In an alloy represented, for example, by a composition of $Fe_{76.4}Cr_{2.0}P_{10.8}C_{2.2}B_{4.2}Si_{4.4}$, good characteristics are obtained, i.e., a core loss of 250-380 kW/m$^3$ at 100 kHz and 0.1 T and relative permeability $\mu$ of 36.8-37.1 in a DC magnetic field of 5500 A/m in a frequency range until 1 MHz.

As one of techniques for providing a satisfactory DC current characteristic in a large-current region (high-field region)) without causing saturation of magnetic flux in a core, there is known a technique of a mixing magnetic powder and a resin, i.e., a nonmagnetic powder, with each other (see Patent Document 3; Japanese Unexamined Patent Application Publication No. 2005-354001). With the known technique, 20% by volume, preferably, 40% by volume of resin is mixed to a Fe—Si alloy so as to suppress saturation of the relative permeability $\mu$ in a high magnetic field.

General soft magnetic iron alloys, such as a FeNi alloy, a Fe—Si alloy, and a Fe—Al—Si alloy, have relatively low electrical resistivity and therefore tend to generate a large eddy-current loss. In order to avoid an increase of the core loss caused by the large eddy-current loss and to obtain a good core loss characteristic, there is also known a technique of mixing a nonmagnetic insulating material, e.g., a resin, to the soft magnetic iron alloy to increase an electrical resistance value, thus improving the core loss characteristic (see Patent Document 4; U.S. Pat. No. 6,284,060 (Japanese Unexamined Patent Application Publication No. H11-238613) and Patent Document 5; U.S. Pat. No. 4,543,208 (Japanese Unexamined Patent Application Publication No. S59-119710 and No. S60-16406)).

However, when a gap is formed in a magnetic path as in the related art, apparent permeability can be reduced, but magnetic flux leaks through the gap, thus resulting in an increase of a core loss including an iron loss and a copper loss. Also, in an application such as a step-up coil in hybrid cars, a further reduction of permeability is required because of the necessity of supplying a large current flow. If the gap is formed in the magnetic path in such an application requiring the supply of a large current flow, mechanical strength is reduced and vibrations are generated due to attraction between magnetic bodies with the gap formed between them. In addition, noise is generated due to the vibrations.

When the amorphous soft magnetic iron alloy, e.g., the alloy represented by the composition of $Fe_{76.4}Cr_{2.0}P_{10.8}C_{2.2}B_{4.2}Si_{4.4}$ (Patent Document 2), is used in a region of large current (i.e., in an application where a current is 100 A or more and a generated magnetic field is 10000 A/m or more), the gap is required to be formed in the magnetic path. In that application, a problem occurs in practical use in that noise is generated due to vibrations near the gap formed in the magnetic path. By using the amorphous soft magnetic iron alloy, however, a good core loss characteristic of 250-380 kW/m$^3$ is obtained in a region of not so large current (i.e., in an application where a current is 100 A or less and a generated magnetic field is 10000 A/m or less). Accordingly, there is no need to mix the nonmagnetic insulating material to increase the electrical resistivity as described in Patent Documents 4-5. In an embodiment described in Patent Document 4, the core loss characteristic is 476-1950 kW/m$^3$ even with mixing of the nonmagnetic insulating material and is inferior to the core loss characteristic of the amorphous soft magnetic iron alloy described in Patent Document 2.

In the structure (Patent Document 1) in which the gap is filled with, e.g., a nonmagnetic body to maintain sufficient strength in a portion around the gap, the man-hours needed in the manufacturing process are increased and the cost is pushed up. Also, just simply filling the gap with, e.g., a nonmagnetic body is not a sufficient measure against the noise and a further improvement of the antinoise measure is required for practical use.

With the technique (Patent Document 3) of mixing the soft magnetic iron alloy and resin with each other to control saturation at a large current, the resin is mixed at a high ratio of 20% by volume or more, thus resulting in a restriction on annealing temperature. Another disadvantage is that the mixed material is susceptible to changes of resin components between before and after the annealing and to characteristic changes during a severe heat resistance test. In other words, the mixed material has various problems when used as materials of cores for use in products which are required to have heat resistance under severe applications, such as a reactor in hybrid cars.

SUMMARY

The magnetic core of the compressed compact is made of a mixed material including an amorphous soft magnetic iron alloy and 10% by volume or more of a nonmagnetic inorganic matter, the amorphous soft magnetic iron alloy being expressed by the following composition:

$Fe_{100-a-b-x-y-z-w-t}Co_aNi_bM_xP_yC_zB_wSi_t$ wherein M is one or two or more elements selected from among Cr, Mo, W, V, Nb, Ta, Ti, Zr, Hf, Pt, Pd and Au, and a, b, x, y, z, w and t represent composition ratios satisfying 0 atom %≦x≦3 atom %, 2 atom %≦y≦15 atom %, 0 atom %<z≦8 atom %, 1 atom %≦w≦12 atom %, 0.5 atom %≦t≦8 atom %, 0 atom %≦a≦20 atom %, 0 atom %≦b≦5 atom %, and 70 atom %≦(100-a-b-x-y-z-w-t)≦80 atom %.

Looking in a microscopic scale, the magnetic core of the compressed compact is in a state where the nonmagnetic inorganic matter is interposed between adjacent portions of the amorphous soft magnetic iron alloy. In such a state, the amorphous soft magnetic iron alloy is not completely continuous and is partly cut by the nonmagnetic inorganic matter. This means that the amorphous soft magnetic iron alloy has magnetic micro-gaps filled by the nonmagnetic inorganic matter. The micro-gaps act to generate demagnetizing fields in a direction to reduce a magnetic field within the magnetic core, thus reducing apparent permeability. By controlling a mixture ratio of the nonmagnetic inorganic matter, the permeability can be reduced to a level suitable for a coil which is used in an application requiring supply of a large current flow. Further, in the magnetic core of the compressed compact, since the permeability is reduced with the presence of the micro-gaps which are smaller than sizes of magnetic particles, instead of a large gap used in the known magnetic core, magnetic flux is prevented from leaking through the gaps, and an increase of the core loss including the iron loss and the copper loss can be suppressed. In addition, the magnetic core of the compressed compact has heat resistance and can suppress vibrations and noise caused by the vibrations.

In the magnetic core of the compressed compact, preferably, a proportion of the nonmagnetic inorganic matter in the mixed material is 20% by volume to 50% by volume.

In the magnetic core of the compressed compact, preferably, an average particle size of the nonmagnetic inorganic matter is 1.0 μm to 30 μm.

The method of producing the magnetic core of the compressed compact according to an embodiment includes the steps of mixing 10% by volume or more of a nonmagnetic inorganic matter to an amorphous soft magnetic iron alloy expressed by the following composition, thus obtaining a mixed material, forming the mixed material into a core compact having a predetermined shape and constituting the magnetic core of the compressed compact, and annealing the core compact:

$Fe_{100-a-b-x-y-z-w-t}Co_aNi_bM_xP_yC_zB_wSi_t$ wherein M is one or two or more elements selected from among Cr, Mo, W, V, Nb, Ta, Ti, Zr, Hf, Pt, Pd and Au, and a, b, x, y, z, w and t represent composition ratios satisfying 0 atom %≦x≦3 atom %, 2 atom %≦y≦15 atom %, 0 atom %<z≦8 atom %, 1 atom %≦w≦12 atom %, 0.5 atom %≦t≦8 atom %, 0 atom %≦a≦20 atom %, 0 atom %≦b≦5 atom %, and 70 atom %≦(100-a-b-x-y-z-w-t)≦80 atom %.

The producing method according to the disclosed embodiment can provide the magnetic core of the compressed compact which has permeability at such a low level as allowing use in an application requiring supply of a large current flow, which can suppress an increase of the core loss including the iron loss and the copper loss, which has heat resistance, and which can suppress vibrations and noise caused by the vibrations.

In the method of producing the magnetic core of the compressed compact according to the disclosed embodiments, preferably, a proportion of the nonmagnetic inorganic matter in the mixed material is 20% by volume to 50% by volume.

In the method of producing the magnetic core of the compressed compact according to the disclosed embodiments, preferably, an average particle size of the nonmagnetic inorganic matter is 1.0 μm to 30 μm.

BRIEF DESCRIPTION OF THE DRAWINGS

FIG. 8A shows a characteristic of the PQ core of Example 1 and FIG. 8B shows a characteristic of a PQ core of Comparative Example 6;

FIG. 9A shows a characteristic of the PQ core of Example 1 and FIG. 9B shows a characteristic of the PQ core of Comparative Example 6.

DESCRIPTION OF THE EMBODIMENTS

Figure 1A:
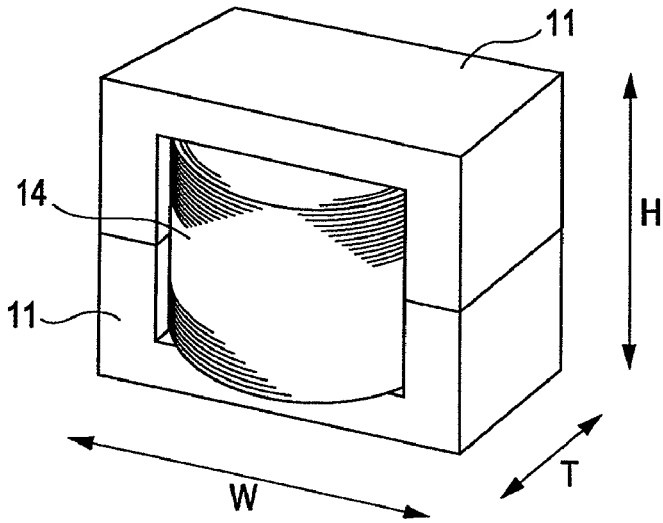
FIG. 1A is a perspective view of a PQ core circuit having a magnetic core according to an embodiment.

An embodiment of the present invention will be described in detail below with reference to the accompanying drawings.

A magnetic core of a compressed compact according to the present invention is made of a mixed material including powder of an amorphous soft magnetic iron alloy and 10% by volume or more of nonmagnetic inorganic powder, the amorphous soft magnetic iron alloy being expressed by the following composition:

$Fe_{100-a-b-x-y-z-w-t}Co_aNi_bM_xP_yC_zB_wSi_t$ wherein M is one or two or more elements selected from among Cr, Mo, W, V, Nb, Ta, Ti, Zr, Hf, Pt, Pd and Au, and a, b, x, y, z, w and t represent composition ratios satisfying 0 atom %≦x≦3 atom %, 2 atom %≦y≦15 atom %, 0 atom %<z≦8 atom %, 1 atom %≦w≦12 atom %, 0.5 atom %≦t≦8 atom %, 0 atom %≦a≦20 atom %, 0 atom %≦b≦5 atom %, and 70 atom %≦(100-a-b-x-y-z-w-t)≦80 atom %.

The amorphous soft magnetic iron alloy is an amorphous soft magnetic alloy (metal glass) containing at least, in addition to Fe as a main component, one or two or more elements M selected from among Cr, Mo, W, V, Nb, Ta, Ti, Zr, Hf, Pt, Pd and Au, as well as P, C and B, while the amorphous soft magnetic iron alloy has the above-mentioned composition.

The amount of the main component Fe is preferably about 70 atom %-about 80 atom %, more preferably about 72 atom %-about 79 atom %, and even more preferably about 73 atom %-about 78 atom % in consideration of saturated magnetization, an ability of forming an amorphous matter, etc.

The amount of added Co is preferably 0 atom %-20 atom % in consideration of an effect of improving saturated magnetization, an improvement of a DC current characteristic, and corrosion resistance. The amount of added Ni is preferably about 0 atom %-about 5 atom % in consideration of the effect of improving saturated magnetization and corrosion resistance.

The element M represented by Cr, Mo, W, V, Nb, Ta, Ti, Zr and Hf can form a passivation oxide film and can improve corrosion resistance of the alloy powder. Those elements can be added solely or in combination of two or more selected from among them. The amount of added M is preferably 0 atom %-3 atom % in consideration of a magnetic characteristic, corrosion resistance, etc.

The amount of added P is preferably about 2 atom %-about 15 atom % in consideration of the ability of forming an amorphous matter, etc. The amount of added C is preferably about 0 atom %-about 8 atom % in consideration of thermal stability, etc. The amount of added B is preferably about 1 atom %-about 12 atom % in consideration of easiness in obtaining the amorphous soft magnetic iron alloy, etc. The amount of added Si is preferably about 0.5 atom %-about 8 atom % in consideration of the easiness in obtaining the amorphous soft magnetic iron alloy, etc. Note that the amorphous soft magnetic iron alloy may further contain unavoidable impurities in addition to the elements denoted in the above-mentioned composition.

Examples of the amorphous soft magnetic iron alloy satisfying the above-described requirements include $Fe_{77.4}P_{7.3}C_{2.2}B_{7.7}Si_{5.4}$, $Fe_{77.9}P_{7.3}C_{2.2}B_{8.2}Si_{4.4}$, $Fe_{77.9}P_{7.3}C_{2.7}B_{7.7}Si_{4.4}$, $Fe_{77.9}Cr_{0.5}P_{9.3}C_{2.2}B_{5.7}Si_{4.4}$, $Fe_{77.9}Cr_{0.5}P_{8.8}C_{2.2}B_{6.2}Si_{4.4}$, $Fe_{77.9}Cr_{0.5}P_{7.3}C_{2.2}B_{7.7}Si_{4.4}$, $Fe_{77.4}Cr_1P_{8.3}C_{2.2}B_{6.7}Si_{4.4}$, $Fe_{76.9}Cr_1P_{8.3}C_{2.2}B_{7.2}Si_{4.4}$, and $Fe_{77.4}Cr_1P_{7.3}C_{2.2}B_{7.7}Si_{4.4}$.

Each of the amorphous soft magnetic alloys belonging to such a series is metal glass that exhibits a temperature interval ΔTx of a supercooled liquid of 25K or more and has a superior soft magnetic characteristic at room temperature. Depending on the composition, the temperature interval ΔTx is further significantly increased to about 30K or more, particularly to about 50K or more in some cases. Herein, ΔTx is defined as the difference between a crystallization start temperature Tx and a glass transition temperature Tg, i.e., ΔTx=Tx−Tg. A larger value of ΔTx means an alloy which is more apt to change into an amorphous state.

In consideration of forming (compaction), handling, etc., the amorphous soft magnetic iron alloy is preferably in the form of particles. In that case, the sizes of soft magnetic iron particles are preferably about 1 μm-about 30 μm in consideration of easiness in producing the particles, the core (iron) loss, etc. The shapes of the soft magnetic iron particles are not limited to particular one and may be either spherical or flat. In consideration of the core loss, however, the particle shape is preferably substantially spherical.

In a choke coil for a power supply, if a gap is formed in a magnetic path as in the related art, magnetic flux leaks through the gap as described above. To reduce the leaked magnetic flux, the so-called dust core has been developed in which a nonmagnetic insulating film is formed around magnetic powder. In the dust core, the nonmagnetic insulating film serves as a micro-gap and an aggregate of the magnetic powder exhibits performance comparable to that of a core provided with a gap. In the dust core, permeability is controlled by adjusting the compaction pressure, the particle size of the magnetic powder, the amount of an added binder, etc.

In an application to, e.g., a step-up coil in hybrid cars, a large current is expected to flow in some cases and a core material having relative permeability μ at a level lower than that of the ordinary dust core is required. Such a level of the relative permeability μ is as low as not controllable with the known dust core, i.e., μ=5−40.

The inventors have accomplished the present invention by finding that, with the use of a material prepared by mixing a nonmagnetic inorganic matter in a predetermined amount or more to an amorphous soft magnetic iron alloy having a particular composition, the relative permeability at a level usable in the step-up coil in the hybrid car can be realized without forming the gap in the magnetic path. More specifically, the inventors have realized that a magnetic core of a compressed compact, which can prevent magnetic flux from leaking through the gap, which can suppress an increase of the core loss including the iron loss and the copper loss, which has heat resistance, and which can suppress vibrations and noise caused by the vibrations, by using the mixed material including an amorphous soft magnetic iron alloy and about 10% by volume or more of a nonmagnetic inorganic matter, the amorphous soft magnetic iron alloy being represented by the following composition:

$$Fe_{100-a-b-x-y-z-w-t}Co_aNi_bM_xP_yC_zB_wSi_t$$

wherein M is one or two or more elements selected from among Cr, Mo, W, V, Nb, Ta, Ti, Zr, Hf, Pt, Pd and Au, and a, b, x, y, z, w and t represent composition ratios satisfying 0 atom %≦x≦3 atom %, 2 atom %≦y≦15 atom %, 0 atom %<z≦8 atom %, 1 atom %≦w≦12 atom %, 0.5 atom %≦t≦8 atom %, 0 atom %≦a≦20 atom %, 0 atom %≦b≦5 atom %, and 70 atom %≦(100-a-b-x-y-z-w-t)≦80 atom %.

The nonmagnetic inorganic matter is given, for example, by ceramic materials such as alumina ($Al_2O_3$) and silica ($SiO_2$). A proportion of the nonmagnetic inorganic matter in the mixed material including the amorphous soft magnetic iron alloy and the nonmagnetic inorganic matter is set to 10% by volume or more in consideration of the permeability at such a level as allowing use in an application requiring supply of a large current flow. Preferably, the proportion is in the range of about 15% by volume to about 50% by volume.

In consideration of forming (compaction), handling, etc., the nonmagnetic inorganic matter is preferably in the form of particles. In that case, the sizes of nonmagnetic inorganic particles are preferably about 1.0 μm to about 30 μm in consideration of homogeneity of the mixed material, etc. The shapes of the nonmagnetic inorganic particles are not limited to particular one and may be either spherical or flat.

The mixed material including the amorphous soft magnetic iron alloy and the nonmagnetic inorganic matter further contains additives, such as a binder and grease, within quantitative and qualitative ranges without departing from the scope of the present invention in order to compact the mixed material into the predetermined shape. Examples usable as the binder include a silicon resin, an acrylic resin, an epoxy resin, and water glass. Examples usable as the grease include lead stearate and aluminum stearate. The binder and the grease remain in small amounts within the compact after the compaction and the annealing. For example, when the silicon resin is used as the binder, silicon is produced by the annealing and adheres to peripheries of the soft magnetic iron particles and the nonmagnetic inorganic particles. A mixture ratio of the binder (resin) is preferably about 15% by volume or less, and the amount of the added grease is preferably about 0.1% by volume to about 5% by volume, more preferably about 1.0% by volume to about 2.5% by volume. Note that it is required to hold minimum the amount of the resin (such as the silicon resin) and the amount of a stearic acid (such as lead stearate), which are mixed and added respectively as the binder and the grease when the compressed compact is formed.

In the method of producing the magnetic core of the compressed compact, about 10% by volume or more of the nonmagnetic inorganic matter is mixed to the amorphous soft magnetic iron alloy, thus obtaining a mixed material. The mixed material is formed into a core compact having a predetermined shape and constituting the magnetic core of the compressed compact. The core compact is subjected to the annealing.

More specifically, first, about 10% by volume or more of the nonmagnetic inorganic matter is mixed to the amorphous soft magnetic iron alloy, thus obtaining a mixed material. The nonmagnetic inorganic matter is mixed to the amorphous soft magnetic iron alloy by using an ordinary powder mixing unit. When producing amorphous soft magnetic iron alloy powder as the amorphous soft magnetic iron alloy, the amorphous soft magnetic iron alloy powder is produced by a water atomization method through the steps of weighing raw materials so that the desired composition of the soft magnetic iron alloy powder is obtained, mixing and melting the raw materials, and jetting the molten alloy into water for rapid cooling. The produced amorphous soft magnetic iron alloy powder is classified to have uniform particle size. The method of producing the amorphous soft magnetic iron alloy is not limited to the water atomization method, and other suitable methods can also be used which include, e.g., a gas atomization method and a liquid rapid-cooling method in which a ribbon obtained by rapidly cooling the molten alloy is pulverized into powder. Processing conditions for the water atomization method, the gas atomization method, and the liquid rapid-cooling method can be set to those used in ordinary cases depending on the kinds of the raw materials.

Next, the mixed material is formed into a core compact having a predetermined shape and constituting the magnetic core of the compressed compact. The shape of the magnetic core of the compressed compact is not limited to particular one and can be set to, e.g., a toroidal shape, an E-shape, a drum-like shape, or a pot-like shape. Also, in the magnetic core of the compressed compact according to the present invention, the magnetic core can be partly or entirely formed of the mixed material. Conditions for forming the core compact can be properly decided depending on the kinds of the mixed raw materials, the shape and the dimensions of the core compact, etc. A cold press or a hot press can be used for the compaction. The compaction is performed, for example, at heating temperature of 80° C.-120° C., pressing pressure of 5000 kg/cm$^2$-20000 kg/cm$^2$, and pressing time of 0.1-5 minutes.

Next, the core compact is subjected to the annealing. Annealing conditions are set to, e.g., temperature of 350° C.-550° C. and time of 30-180 minutes in consideration of temperature uniformity, etc.

The thus-produced magnetic core of the compressed compact is made of the mixed material including the amorphous soft magnetic iron alloy and the nonmagnetic inorganic matter. Looking in a microscopic scale, the magnetic core of the compressed compact is in a state where the nonmagnetic inorganic matter is interposed between adjacent portions of the amorphous soft magnetic iron alloy. In such a state, the amorphous soft magnetic iron alloy is not completely continuous and is partly cut by the nonmagnetic inorganic matter. This means that the amorphous soft magnetic iron alloy has magnetic micro-gaps filled by the nonmagnetic inorganic matter. The micro-gaps act to generate demagnetizing fields in a direction to reduce a magnetic field within the magnetic core, thus reducing apparent permeability. By controlling the mixture ratio of the nonmagnetic inorganic matter, the permeability can be reduced to a level suitable for a coil which is used in an application requiring supply of a large current flow. Further, in the magnetic core of the compressed compact, the permeability is reduced with the presence of the micro-gaps which are smaller than sizes of magnetic particles, instead of a large gap used in the known magnetic core. Therefore, magnetic flux is prevented from leaking through the gaps, and an increase of the loss including the iron loss and the copper loss can be suppressed. In addition, the magnetic core has heat resistance and can suppress vibrations and noise caused by the vibrations.

Figure 1B:
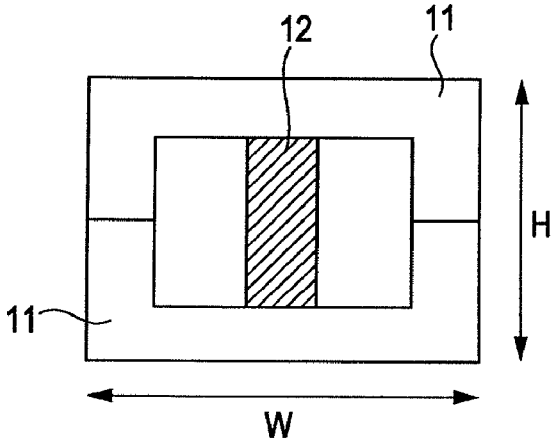
FIG. 1B shows one core form according to the embodiment in which no gap is formed in a magnetic path.
Figure 1C:
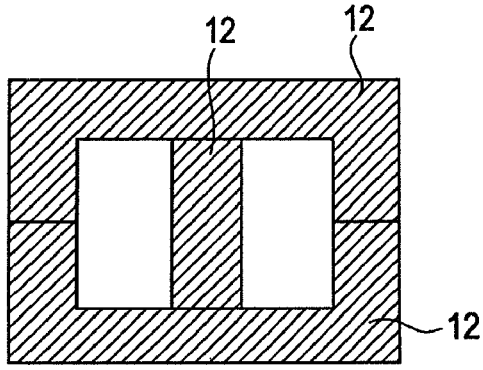
FIG. 1C shows another core form according to the embodiment in which a core material according to the present invention is used in the entirety of the core.
Figure 1D:
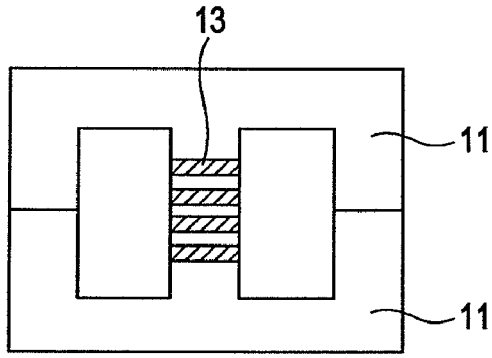
FIG. 1D shows a core form in which a gap is formed in a magnetic path, i.e., a known structure of Comparative Example.

The following description is given of examples carried out to clarify the advantages of the present invention. FIG. 1A is a perspective view of a reactor having the magnetic core according to the present invention, and FIGS. 1B and 1C show a core portion of the reactor. FIG. 1D shows a core portion of Comparative Example. The core portion of the reactor has a width W, a depth T, and a height H. Reference numeral 14 denotes a coil.

Soft magnetic iron alloy particles were produced by atomizing soft magnetic alloy of $Fe_{74.3}Cr_{1.96}P_{9.04}C_{2.16}B_{7.54}Si_{4.87}$ into powder with the water atomization method. The soft magnetic iron alloy particles were mixed with alumina as the nonmagnetic inorganic matter, thus preparing a mixed material. At that time, 9.8% by volume of a silicon resin (made by Shinetsu Chemical Co., Ltd. under the trade name of Silicon Resin ES1001 N) was added as the binder, and 1.7% by volume of lead stearate was added as the grease. Various kinds of mixed materials were prepared in a similar manner while changing the mixture ratio of the nonmagnetic inorganic matter.

A central portion of a magnetic core of a compressed compact (corresponding to the magnetic core of the present invention), denoted by reference numeral 12 in FIGS. 1B and 1C, was formed by using each of the mixed materials. At that time, the pressing pressure was set to 20000 kg/cm$^2$ and the pressing time was set to 1 minute. Then, the formed magnetic core of the compressed compact was subjected to annealing through the steps of heating the magnetic core up to 447° C. at a temperature rising rate of 0.5° C./min in a nitrogen atmosphere, and holding it in the heated state for 2 hours. A PQ core was fabricated by combining the thus-obtained central portion 12 of the magnetic core of the compressed compact with a peripheral portion of the magnetic core of the compressed compact (corresponding to the known magnetic core), denoted by reference numeral 11 in FIG. 1B. While FIG. 1B shows the case where the magnetic core of the compressed compact according to the present invention is used only in the central portion 12, the present invention is not limited to such an arrangement. As shown in FIG. 1C, the present invention is similarly applicable to the case where the magnetic core of the compressed compact is entirely formed by using only the core material according to the present invention, as indicated by 12. In any of the magnetic cores shown in FIGS. 1B and 1C, a magnetic path is formed to be continuous without including a magnetic gap.

Figure 2:
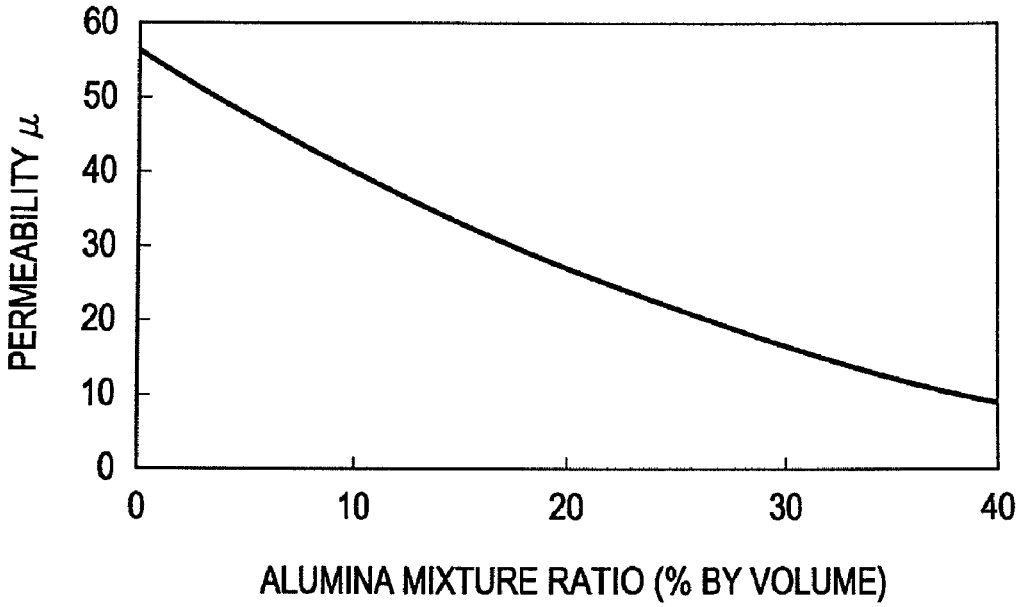
FIG. 2 is a graph showing the relationship between an alumina mixture ratio and relative permeability in the magnetic core according to the disclosed embodiment.

Relative permeability was measured while changing the mixture ratio of the nonmagnetic inorganic matter d. Table 1 and FIG. 2 show changes of the relative permeability μ when an alumina mixture ratio was changed. As seen from FIG. 2, the mixture ratio of about 10% by volume or more is needed to realize the relative permeability μ=40 or less which is suitable for a coil used in an application requiring supply of a large current flow.

TABLE 1

| | Content (% by volume) | | | | μ Relative |
|---|---|---|---|---|---|
| | Iron alloy | Alumina | Binder | Grease | permeability |
| Sample a | 72.4 | 16.0 | 9.8 | 1.8 | 35.1 |
| Sample b | 62.5 | 26.0 | 9.8 | 1.7 | 30.0 |
| Sample c | 52.6 | 36.0 | 9.8 | 1.6 | 24.4 |
| Sample d | 42.7 | 46.0 | 9.8 | 1.5 | 19.5 |
| Sample e | 32.8 | 56.0 | 9.8 | 1.4 | 15.0 |

Figure 3:
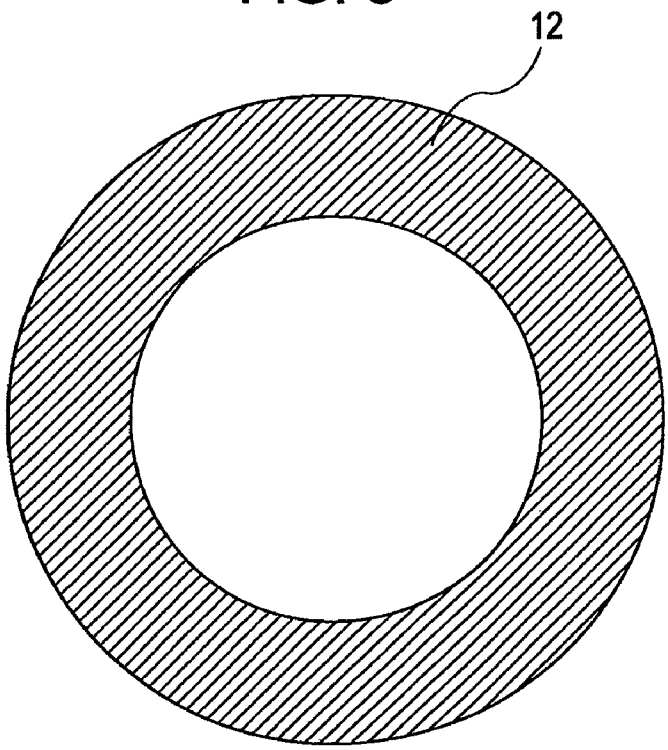
FIG. 3 shows a shape of the magnetic core used for evaluating a core loss of the magnetic core according to the disclosed embodiment.
Figure 4:
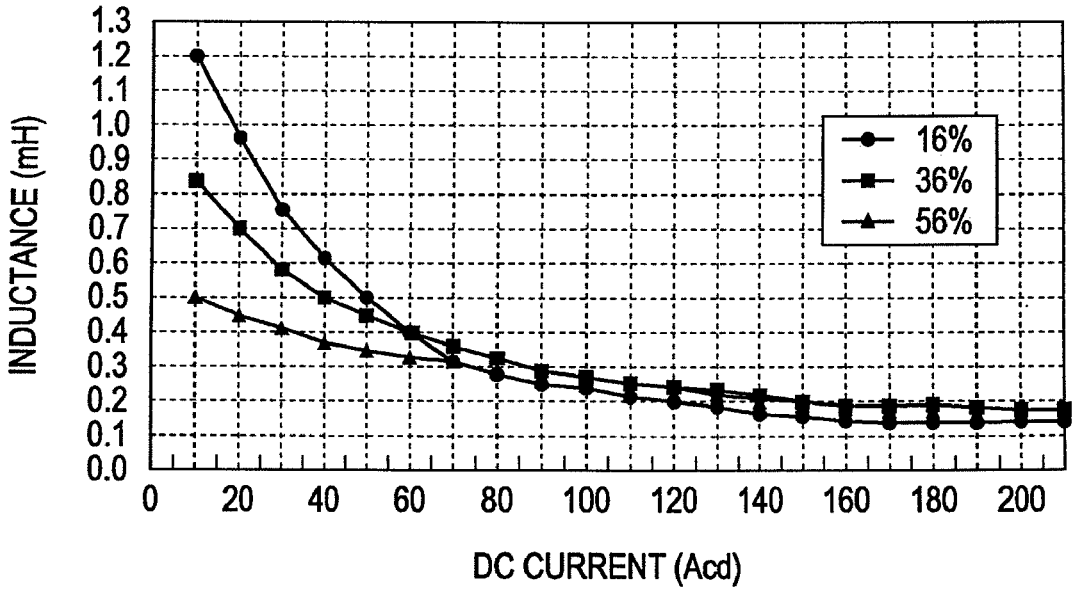
FIG. 4 is a graph showing a DC current characteristic of a coil which employs the magnetic core according to the disclosed embodiment.

Further, a choke coil was fabricated by using a magnetic core (FIG. 3) made of each of the core materials which were produced as described above, but in which the mixture ratio of alumina as the nonmagnetic inorganic matter was changed to 16% by volume, 36% by volume, and 56% by volume. Dimensions of the core, shown in FIG. 3, used for fabricating the choke coil, were set to an outer diameter of 20 mm, an inner diameter of 12 mm, and a thickness of 6.8 mm. Each of the fabricated choke coils was measured for inductance when a DC current was superimposed (i.e., a DC current characteristic). The measured result is shown in FIG. 4. More specifically, the DC current characteristic was obtained by measuring inductance with the use of an LCR meter 4284A, made by Agilent Technologies, at a frequency of 100 kHz and a measurement signal current of 10 mA. As seen from FIG. 4, a characteristic curve is sloped at a smaller gradient at a higher alumina content. This means that the higher the alumina content, the lower the relative permeability and the harder magnetic saturation occurs. Thus, as seen from FIGS. 2 and 4, the magnetic core of the compressed compact according to the embodiment has lower relative permeability and is harder to cause magnetic saturation.

Next, the relationship between the relative permeability and the core loss was measured.

Example 1

Amorphous soft magnetic iron alloy particles with an average particle size (D50) of 12 μm were produced by atomizing an amorphous soft magnetic alloy having a composition of $Fe_{77.9}Cr_1P_{7.3}C_{2.2}B_{7.7}Si_{3.9}$ with the water atomization method. Then, 53.6% by volume (72% by weight) of the thus-produced amorphous soft magnetic iron alloy particles were mixed with 35.0% by volume (25.7% by weight) of alumina particles, i.e., the nonmagnetic inorganic matter, with an average particle size (D50) of 6 μm to prepare a mixed material. At that time, 9.8% by volume (2.0% by weight) of a silicon resin (made by Shinetsu Chemical Co., Ltd. under the trade name of Silicon Resin ES1001N) was added as the binder, and 1.6% by volume (0.3% by weight) of lead stearate was added as the grease. Various kinds of mixed materials were prepared in a similar manner while changing the mixture ratio of the nonmagnetic inorganic matter. The actually used mixture ratios of the nonmagnetic inorganic matter are shown in Table 2.

TABLE 2

| | Content (% by volume) | | | | μ | Core |
|---|---|---|---|---|---|---|
| Example Sample | Iron alloy | Alumina | Binder | Grease | Relative permeability | loss kW/m³ |
| Sample 1 | 53.6 | 35.0 | 9.8 | 1.6 | 14.4 | 2257.9 |
| Sample 2 | 71.5 | 16.0 | 10.8 | 1.8 | 27.6 | 840.5 |
| Sample 3 | 79.0 | 8.0 | 11.2 | 1.8 | 43.5 | 342.3 |
| Sample 4 | 82.8 | 4.0 | 11.4 | 1.9 | 50.0 | 307.7 |

Each of the thus-prepared mixed materials was compacted and formed into a magnetic core having a shape shown in FIG. 1C, in which a magnetic path had no gap, followed by annealing. More specifically, the amorphous soft magnetic iron alloy particles were annealed through the steps of heating the magnetic core up to 430° C. at a temperature rising rate of 0.5° C./min, and holding it in the heated state for 2 hours. The thus-obtained toroidal core was measured for the relationship between the relative permeability and the core loss. The measured results are shown in Table 2 and FIG. 6. The core loss was evaluated by forming each of the mixed materials into the magnetic core shown in FIG. 3, and measuring a value of the core loss at a frequency of 100 kHz and a maximum magnetic flux density of 100 mT with an analyzer SY-8217 BH made by Iwatsu Test Instruments Corporation.

Comparative Example 1

Amorphous soft magnetic iron alloy particles with an average particle size (D50) of 12 μm were produced by atomizing an amorphous soft magnetic alloy having a composition of $Fe_{77.9}Cr_1P_{7.3}C_{2.2}B_{7.7}Si_{3.9}$ with the water atomization method. Then, 86.5% by volume of the thus-produced amorphous soft magnetic iron alloy particles were mixed with 11.6% by volume of a silicon resin (made by Shinetsu Chemical Co., Ltd. under the trade name of Silicon Resin ES1001N) as the binder and 1.6% by volume of lead stearate as the grease, thus preparing a mixed material. The prepared mixed material was compacted and formed into a magnetic core having a shape shown in FIG. 1D, in which a magnetic path had four gaps 13. Also, for evaluation of the core loss, the mixed material was compacted and formed into a toroidal core (EI-22 type) having a shape shown in FIG. 5 (in which a magnetic path had one gap 13) with a width W of 22 mm, a height H of 20.2 mm, and a depth T of 5.75 mm. At that time, the toroidal core was formed while changing the gap 13 to 2.63 mm, 1.65 mm, 0.98 mm, 0.65 mm, 0.32 mm, and 0 mm. A glass epoxy resin was filled as a gap material in the gap 13. The thus-obtained magnetic cores were measured for the relationship between the relative permeability and the core loss at a frequency of 50 kHz in a similar manner to that in Example 1. The measured results are shown in Table 3 and FIG. 6.

TABLE 3

| Materials | Gap mm | μ Relative permeability | Core loss kW/m³ |
|---|---|---|---|
| Comparative Example 1 | 0.0 | 70.9 | 293.4 |
| Comparative Example 1 | 0.32 | 47.0 | 386.7 |
| Comparative Example 1 | 0.65 | 40.8 | 493.4 |
| Comparative Example 1 | 0.98 | 38.1 | 565.8 |
| Comparative Example 1 | 1.65 | 34.9 | 712.2 |
| Comparative Example 1 | 2.63 | 34.2 | 778.1 |

COMPARATIVE EXAMPLE 2

Figure 5:
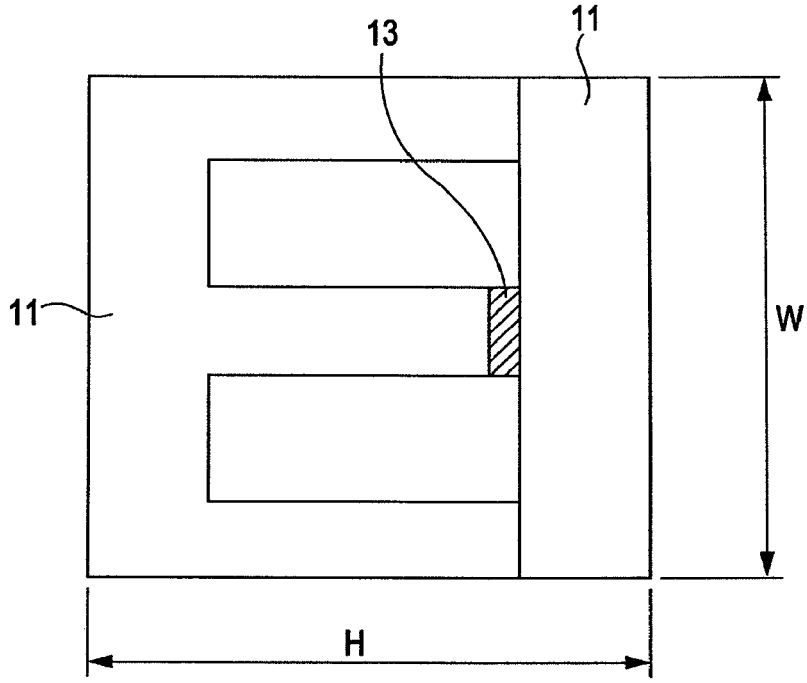
FIG. 5 shows a core shape which has a gap and is used for evaluating a core loss of the magnetic core of Comparative Example.

Magnetic cores each having a shape shown in FIG. 5 were formed in a similar manner to that in Comparative Example 1 except that the soft magnetic iron alloy in Comparative Example 1 was replaced with ferrite (PC40 made by TDK Corporation). Those magnetic cores were measured for the relationship between the relative permeability and the core loss in a similar manner to that in Example 1. The measured results are shown in Table 4 and FIG. 6.

TABLE 4

| Materials | Gap mm | μ Relative permeability | Core loss kW/m$^3$ |
|---|---|---|---|
| Comparative Example 2 | 0.0 | 2303 | 146.9 |
| Comparative Example 2 | 0.32 | 98.3 | 188.1 |
| Comparative Example 2 | 0.65 | 68.1 | 354.5 |
| Comparative Example 2 | 0.98 | 59.0 | 452.6 |
| Comparative Example 2 | 1.65 | 51.8 | 587 |
| Comparative Example 2 | 2.63 | 48.9 | 680.9 |

Figure 6:
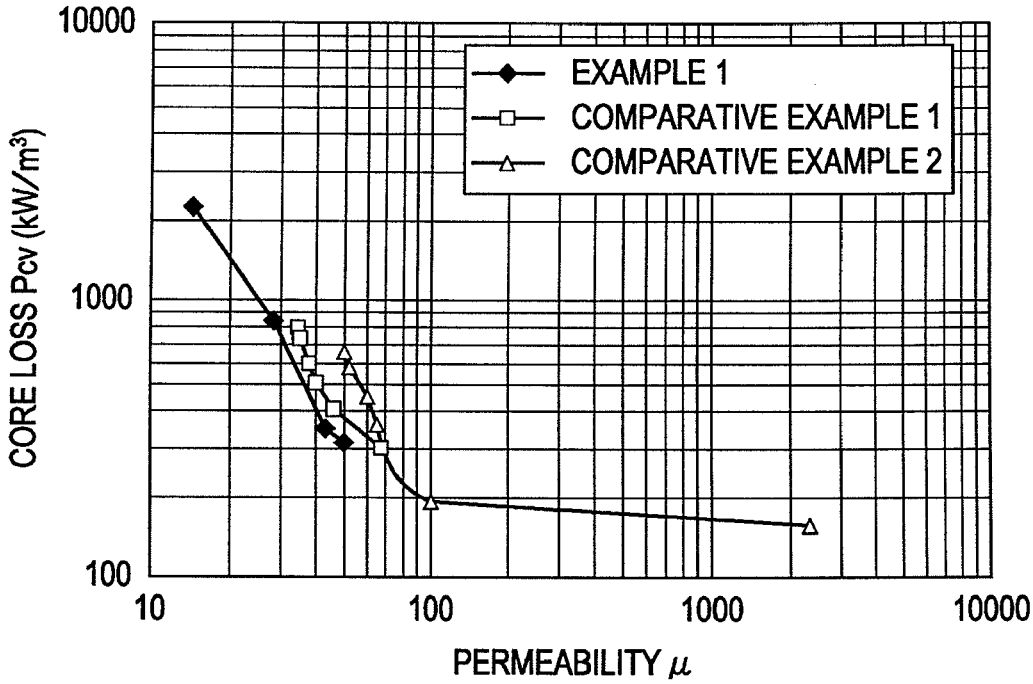
FIG. 6 is a graph showing the relationship between a core loss and permeability in the magnetic cores of Example 1 and Comparative Example.

As seen from FIG. 6, at the relative permeability (μ=30 or less) needed in a coil used in an application requiring supply of a large current flow, e.g., at μ=27.6 (corresponding to 16.0% by volume of the alumina mixture ratio), the toroidal core using the magnetic core of the compressed compact according to the present invention has a smaller core loss than the toroidal cores (Comparative Examples 1 and 2) each having the gap.

Further, overall evaluation including heat resistance, noise and vibrations, a magnetic saturation characteristic, and a cost were carried out not only on Example 1 and Comparative Examples 1 and 2, but also other Comparative Examples using Sendust (Fe—Si—Al alloy), silicon steel (Fe—Si alloy), and Permalloy (Fe—Ni alloy).

Details of each evaluation item were set as follows. The heat resistance was evaluated by measuring changes over time of the core loss when each sample was placed in an environment at 180° C. When a change rate after the lapse of 3000 hours was within 10%, the sample was marked by ⊙. When it was within 25%, the sample was marked by ○, and when it was 25% or more, the sample was marked by ×.

As to noise, the magnitude (dB(A)) of noise at various frequencies were measured by using a precision noise meter LA-4350 made by Ono Sokki Co., Ltd. As to vibrations, an acceleration pickup voltage (V) was measured under conditions at an amplitude Bm=0.3 T of magnetic flux density and a frequency of 9 kHz by using an acceleration pickup PV-90B (output: 100 m/s$^2$/V) made by RION Co., Ltd. When the noise was 45 dB(A) or less and the vibrations were 0.01 V or less, the sample was marked by ⊙, and when the noise was 50 dB(A) or less and the vibrations were 0.02 V or less, the sample was marked by ○. When the noise was 55 dB(A) or less and the vibrations were 0.05 V or less, the sample was marked by Δ, and when the noise was 55 dB(A) or more and the vibrations were 0.05 V or more, the sample was marked by ×.

The saturation magnetic characteristic (Bs) was measured by using a VSM (Vibrating Sample Magnetometer). In the case of Bs>1.5 T, the sample was marked by ⊙, and in the case of 1.5 T≧Bs>1.2 T, the sample was marked by ○. In the case of 1.2 T≧Bs>1.0 T, the sample was marked by Δ, and in the case of Bs≦1.0 T, the sample was marked by ×.

As to the cost, the sample was marked by ⊙ when the cost was comparable to that of the magnetic core of Example 1 which was mainly made of the amorphous soft magnetic alloy and had the shape shown in FIG. 1C with no gap formed in the magnetic path. The sample was marked by ○ when the cost was comparable to that of the magnetic core of Comparative Example 1 which was mainly made of the amorphous soft magnetic alloy and had the shape shown in FIG. 1D with the gaps 13 formed in the magnetic path. The sample was marked by × when the cost was higher those of the above two cases.

As to the core loss, the sample was marked by ⊙ when the core loss was 200 kW/m$^3$ or less at a frequency of 50 kMz and a measurement magnetic flux density of Bs=100 mT. The sample was marked by ○ when the core loss was 400 kW/m$^3$ or less, and by × when the core loss exceeds 400 kW/m$^3$

COMPARATIVE EXAMPLE 3

86.5% by volume of Sendust ($Fe_{84.5}Si_{10}Al_{5.5}$ (composition=% by weight)) with an average particle size of 12 μm was mixed with 11.6% by volume of Silicon Resin ES1001N (made by Shinetsu Chemical Co., Ltd.) as the binder and 1.9% by volume of lead stearate as the grease, thus preparing a mixed material. The prepared mixed material was compacted and formed into a magnetic core (Comparative Example 3) at a heating temperature of 200° C., which had the shape shown in FIG. 1D and FIG. 5 with the gap 13 formed in the magnetic path.

COMPARATIVE EXAMPLE 4

The so-called U-shaped core (Comparative Example 4) was fabricated by punching out a thin band, which was made of silicon steel ($Fe_{93.5}Si_{6.5}$ (composition=% by weight) and had a thickness of 100 μm, to obtain thin sheets, and bonding the thin sheets with each other to form a multilayered body while forming a gap in a magnetic path.

COMPARATIVE EXAMPLE 5

86.5% by volume of Permalloy ($Fe_{50}Ni_{50}$ (% by weight)) with an average particle size of 15 μm was mixed with 11.6% by volume of Silicon Resin ES1001N (made by Shinetsu Chemical Co., Ltd.) as the binder and 1.9% by volume of lead stearate as the grease, thus preparing a mixed material. The prepared mixed material was compacted and formed into a magnetic core (Comparative Example 5) at a heating temperature of 500° C., which had the shape shown in FIG. 5 with the gap 13 formed in the magnetic path.

The toroidal cores of Example 1, Comparative Example 1, and Comparative Examples 3-5 were evaluated in accordance with the above-described evaluation criteria. The evaluated results are shown in Table 5 given below. As seen from Table 5, the magnetic core of the compressed compact according to the present invention was superior in all the items, i.e., core loss, heat resistance, noise and vibrations, magnetic saturation characteristic, and cost. In other words, the magnetic core of the compressed compact according to the present invention has relative permeability at such a low level as allowing use in an application requiring supply of a large current flow, and can suppress an increase of the core loss including the iron loss and the copper loss. Further, it has heat resistance and can suppress vibrations and noise caused by the vibrations.

TABLE 5

| Core materials | Core loss | Heat resistance | Noise and vibrations | Magnetic saturation characteristic | Cost |
|---|---|---|---|---|---|
| Example 1 | ⊙ | ⊙ | ⊙ | ○ | ⊙ |
| Com. Ex. 1 | ○ | ⊙ | X | ○ | ○ |
| Com. Ex. 3 | X | ⊙ | X | Δ | ○ |
| Com. Ex. 4 | X | ⊙ | X | ○ | ○ |
| Com. Ex. 5 | X | ⊙ | X | ○ | X |

TABLE 6

| | Content (% by volume) | | | | Evaluation | Core loss change % |
|---|---|---|---|---|---|---|
| Com. Example 1 | Iron alloy | Alumina | Binder | Grease | of heat resistance | After 3000 hours |
| Sample A | 88.6 | 0.0 | 9.8 | 1.6 | ⊙ | 0.8 |
| Sample B | 86.6 | 0.0 | 11.6 | 1.8 | ○ | 17.3 |
| Sample C | 81.6 | 0.0 | 16.6 | 1.8 | X | 41.5 |

Figure 7:
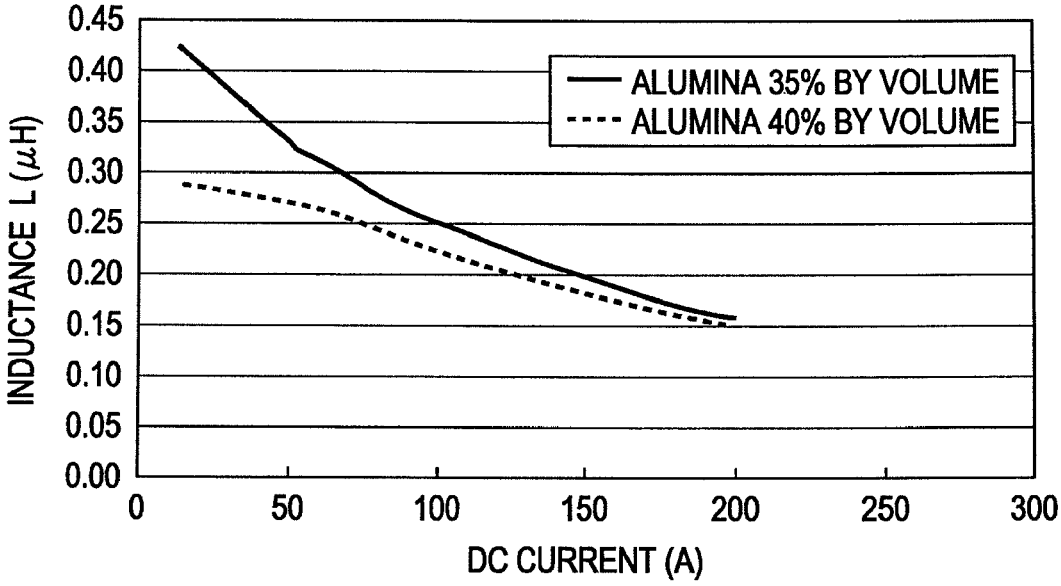
FIG. 7 is a graph showing a DC current characteristic of inductance in a reactor using the magnetic core of Example 1.
Figure 8A:
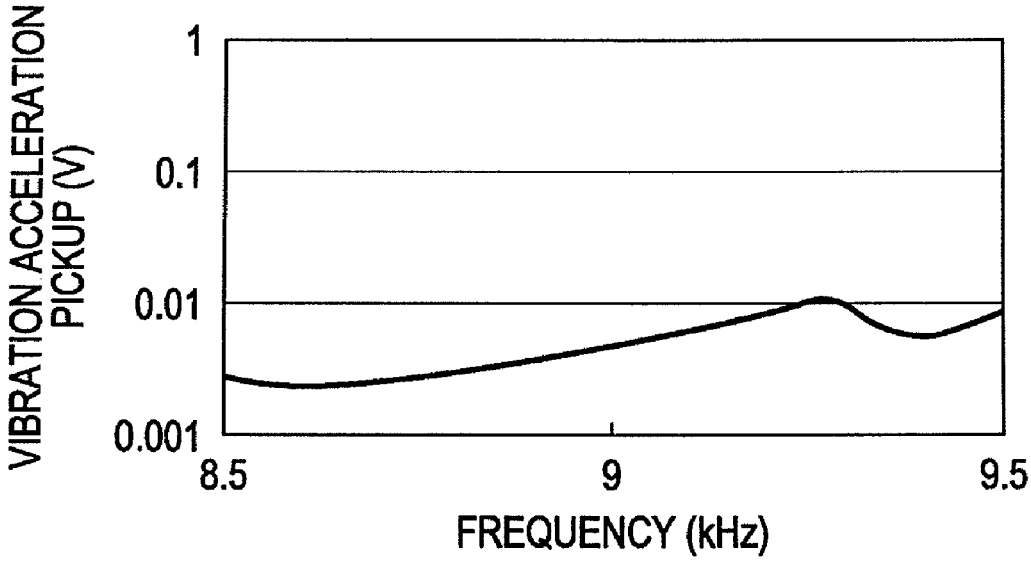
FIGS. 8A and 8B show a frequency characteristic of vibrations, more specifically
Figure 8B:
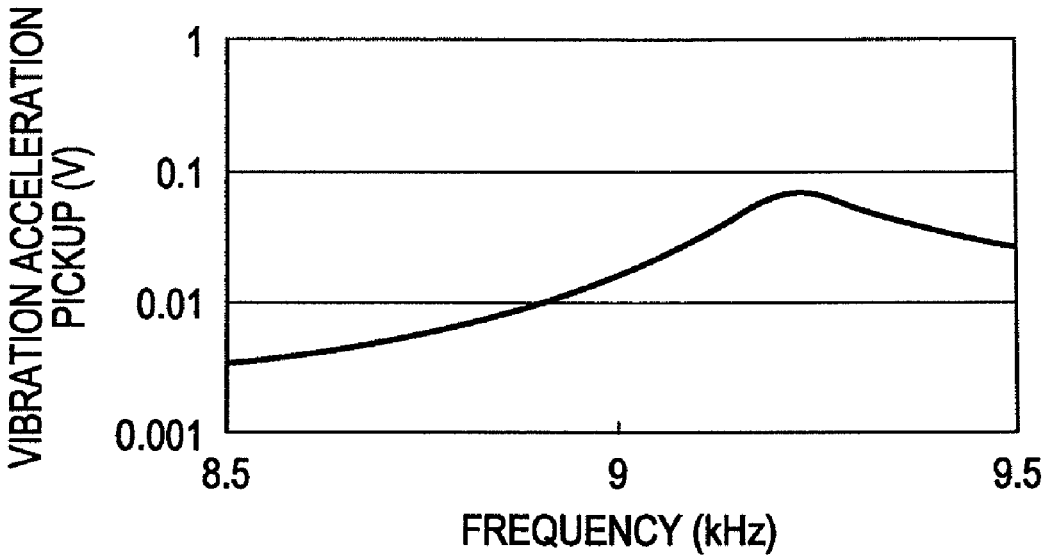
Figure 9A:
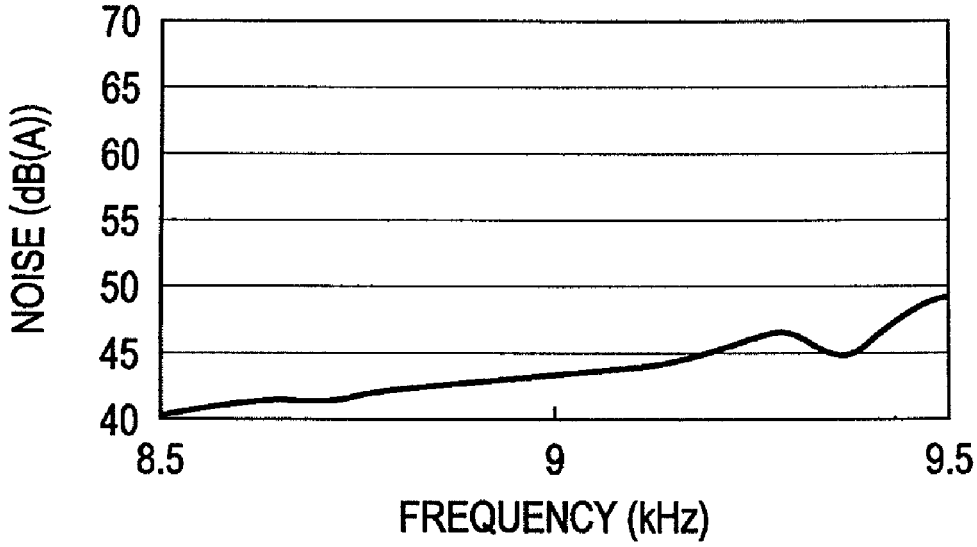
FIGS. 9A and 9B show a frequency characteristic of noise, more specifically
Figure 9B:
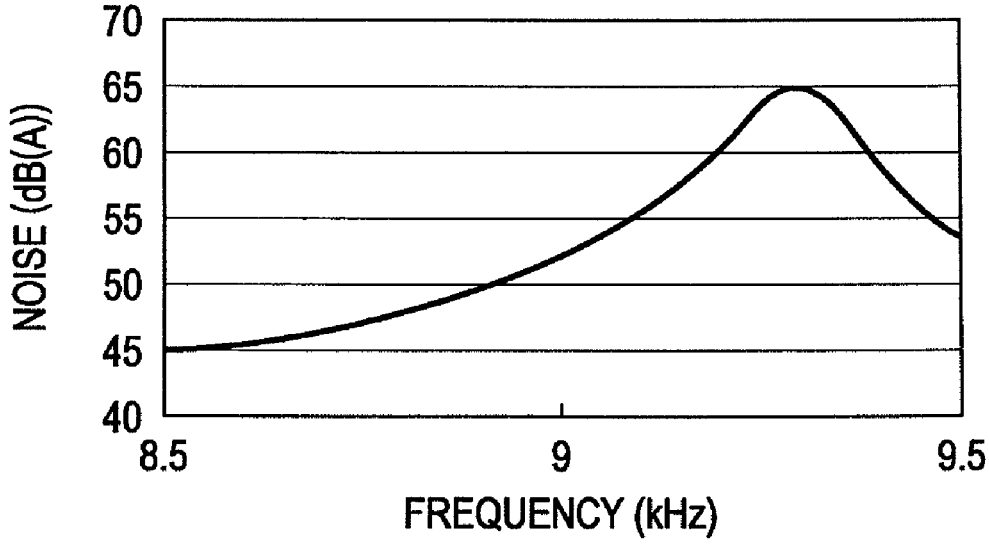

Verification was carried out on a noise improving effect of a reactor which was made of the materials used in Example 1 and had the core shape shown in FIG. 1C. Assuming a practical application for use in a step-up coil in hybrid cars, the core size was herein set to a width W of 74 mm, a depth T of 50 mm, and a height H of 77 mm, and the number of coil windings was set to 65. FIG. 7 shows an inductance versus DC current characteristic in the reactor. Effects of improving a vibration level and a noise level were closely evaluated by using the reactor. Also, by using the same materials as in Comparative Example 1, another reactor having the same core size was formed in the shape shown in FIG. 1D with four alumina sheets of 2.5 mm inserted as gap materials (Comparative Example 6). The evaluated results of vibrations and nose are shown in FIGS. 8 and 9. More specifically, in FIGS. 8A and 8B showing a vibration characteristic with respect to frequency, FIG. 8A shows a vibration characteristic of the PQ core of Example 1, and FIG. 8B shows a vibration characteristic of the PQ core of Comparative Example 6. In FIGS. 9A and 9B showing a noise characteristic with respect to frequency, FIG. 9A shows a noise characteristic of the PQ core of Example 1, and FIG. 9B shows a noise characteristic of the PQ core of Comparative Example 6. As seen from FIGS. 8A and 9A, a significant improvement was confirmed for both the noise and the vibrations. In the PQ core of Example 1, the noise and the vibrations were avoided from increasing and were kept stable. In the PQ core of Comparative Example 6, the noise and the vibrations were increased at a particular frequency.

In Comparative Example 1, heat resistance was evaluated when the content of the binder (nonmagnetic organic matter such as resin) was increased instead of the nonmagnetic inorganic matter. Amorphous soft magnetic iron alloy particles with an average particle size (D50) of 12 μm were produced by atomizing an amorphous soft magnetic alloy having a composition of $Fe_{77.9}Cr_1P_{7.3}C_{2.2}B_{7.7}Si_{3.9}$ with the water atomization method. The thus-produced amorphous soft magnetic iron alloy particles were mixed with a silicon resin (made by Shinetsu Chemical Co., Ltd. under the trade name of Silicon Resin ES1001N) as the binder and lead stearate as the grease, thus preparing a mixed material. The prepared mixed material was compacted and formed at various mixture ratios into toroidal cores (EI-22 type) each having the shape shown in FIG. 5 with a width W of 22 mm, a height H of 20.2 mm, and a depth T of 5.75 mm for evaluation of the core loss.

Figure 10:
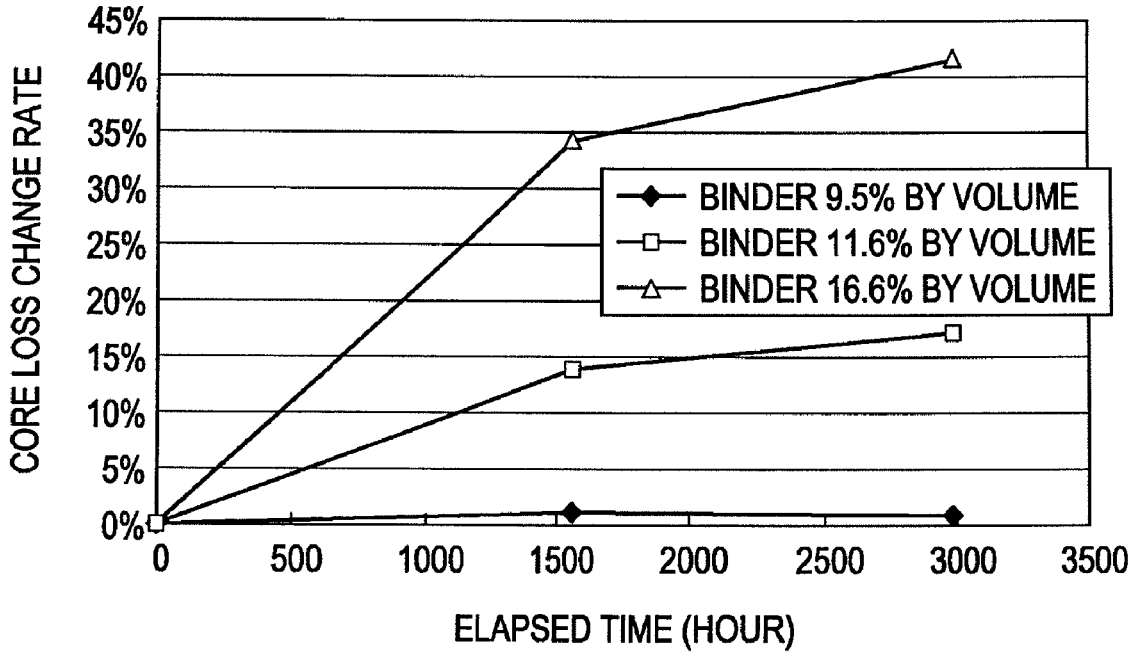
FIG. 10 is a graph showing a core loss change rate in Comparative Example 1 under environment of 180° C. when a mixture ratio of a binder (resin) is gradually increased.

The evaluated results of the heat resistance are shown in Table 6 and FIG. 10. The heat resistance was evaluated by rating the measured results with marks ⊙, ○ and × on the basis of a core loss change rate when each sample was placed in an environment at 180° C. As seen from Table 6 and FIG. 10, the core loss change rate over time is extremely increased after 3000 hours at the resin content of 15% by volume or more.

From the foregoing results, it is concluded that the amounts of the resin (such as the silicon resin) and the stearic acid (such as lead stearate) added respectively as the binder and the grease when forming the magnetic core of the compressed compact are required to be kept minimum. Preferably, the mixture ratio of the binder resin is 15% by volume or less, and the mixture ratio of the grease is 0.1% by volume to 5% by volume.

Note that the present invention is not limited to the above-described embodiments and can be practiced in various modified forms. For example, the kinds and the contents of components constituting the magnetic core, and the processing conditions, etc. can be variously modified without departing from the scope of the present invention.

The magnetic core according to the present invention can be applied to, for example, a step-up coil in hybrid cars.

What is claimed is:

1. A magnetic core made of a mixed material including powder of an amorphous soft magnetic iron alloy and about 10% by volume or more of a ceramic material powder, the mixed material including a binder for compacting the mixed material into a predetermined shape, the amorphous soft magnetic iron alloy being expressed by the following composition:

$$Fe_{100-a-b-x-y-z-w-t}CO_aNi_bM_xP_yC_zB_wSi_t$$

wherein M is one or two or more elements selected from among Cr, Mo, W, V, Nb, Ta, Ti, Zr, Hf, Pt, Pd and Au, and a, b, x, y, z, w and t represent composition ratios satisfying 0 atom %≦x≦3 atom %, 2 atom %≦y≦15 atom %, 0 atom %<z≦8 atom %, 1 atom %≦w≦12 atom %, 0.5 atom %≦t≦8 atom %, 0 atom %≦a≦20 atom %, 0 atom %≦b≦5 atom %, and 70 atom %≦(100-a-b-x-y-z-w-t)≦80 atom %.

2. The magnetic core according to claim 1, wherein a proportion of the ceramic material powder in the mixed material is about 20% by volume to about 50% by volume.

3. The magnetic core according to claim 2, wherein an average particle size of the ceramic material powder is about 1.0 μm to about 30 μm.

4. The magnetic core according to claim 1, wherein the magnetic core has micro-gaps that are smaller in size than a size of magnetic particles in the magnetic core such that a magnetic path in the magnetic core is magnetically continuous.

5. A magnetic core made of a mixed material including powder of an amorphous soft magnetic iron alloy and about 10% by volume or more of a ceramic material powder, the mixed material including a binder for compacting the mixed material into a predetermined shape, the amorphous soft magnetic iron alloy being expressed by the following composition:

$$Fe_{100-a-b-x-y-z-w-t}CO_aNi_bM_xP_yC_zB_wSi_t$$

wherein M is one or two or more elements selected from among Cr, Mo, W, V, Nb, Ta, Ti, Zr, Hf, Pt, Pd and Au, and a, b, x, y, z, w and t represent composition ratios satisfying 0 atom %≦x≦3 atom %, 2 atom %≦y≦15 atom %, 0 atom %<z≦8 atom %, 1 atom %≦w≦12 atom %, 0.5 atom %≦t≦8 atom %, 0 atom %≦a≦20 atom %, 0 atom %≦b≦5 atom %, and 70 atom %≦(100-a-b-x-y-z-w-t)≦80 atom %, wherein a proportion of the ceramic material powder in the mixed material is about 20% by volume to about 50% by volume, wherein an average particle size of the ceramic material powder is about 1.0 μm to about 30 μm, and wherein the magnetic core has micro-gaps that are smaller in size than a size of magnetic particles in the magnetic core such that a magnetic path in the magnetic core is magnetically continuous.

* * * * *